US008608626B2

(12) United States Patent
Campbell

(10) Patent No.: US 8,608,626 B2
(45) Date of Patent: Dec. 17, 2013

(54) ROWING MACHINE SIMULATOR

(71) Applicant: Rowperfect Pty Ltd., Harbord (AU)

(72) Inventor: Mark Campbell, Harbord (AU)

(73) Assignee: Rowperfect Pty Ltd, Harbord, NSW (AU)

( * ) Notice: Subject to any disclaimer, the term of this patent is extended or adjusted under 35 U.S.C. 154(b) by 0 days.

(21) Appl. No.: 13/648,722

(22) Filed: Oct. 10, 2012

(65) Prior Publication Data

US 2013/0035216 A1 Feb. 7, 2013

Related U.S. Application Data

(63) Continuation-in-part of application No. 12/018,702, filed on Jan. 23, 2008, now abandoned.

(30) Foreign Application Priority Data

Jan. 23, 2007 (AU) ..... 2007900315

(51) Int. Cl.
*A63B 69/06* (2006.01)

(52) U.S. Cl.
USPC ..... 482/72

(58) Field of Classification Search
USPC ..... 482/51, 72, 73, 110, 111; D21/674
See application file for complete search history.

(56) References Cited

U.S. PATENT DOCUMENTS

| | | | | |
|---|---|---|---|---|
| 319,686 | A | | 6/1885 | Farmer |
| 641,596 | A | | 1/1900 | Kerns |
| 740,443 | A | | 10/1903 | Korth |
| 764,118 | A | | 7/1904 | Duffner |
| 1,111,269 | A | | 9/1914 | Medart |
| 1,504,375 | A | | 8/1924 | Phillips |
| 1,577,809 | A | | 3/1926 | Randall |
| 1,707,791 | A | | 4/1929 | Anderson |
| 1,782,728 | A | * | 11/1930 | Kiefer ..... 482/72 |
| 1,905,092 | A | | 4/1933 | Hardy |
| 3,266,801 | A | | 8/1966 | Johnson |

(Continued)

FOREIGN PATENT DOCUMENTS

| | | | |
|---|---|---|---|
| EP | 376403 | A1 * | 7/1990 |
| RU | 1796227 | A1 * | 2/1993 |
| RU | 2092208 | C1 * | 10/1997 |

OTHER PUBLICATIONS

The Office Action for U.S. Appl. No. 12/018,702 mailed Mar. 6, 2009 (31 pages).

(Continued)

*Primary Examiner* — Oren Ginsberg
(74) *Attorney, Agent, or Firm* — Dicke, Billig & Czaja, PLLC

(57) ABSTRACT

One aspect is a rowing machine with a longitudinally extending beam and a seat mounted to said beam and slidable therealong. A frame is mounted to said beam and slidably movable therealong independently of said seat. A pair of foot rests are mounted to a user end of said frame. A flywheel is rotatably mounted by a flywheel shaft to said frame, said flywheel shaft mounted to said frame a height less than a radius of said flywheel above said beam. The flywheel is drivable by a cable through a transmission mechanism mounted to said frame such that one end of said cable remote from said flywheel is connected to a handgrip and the other end of said cable connected to a cable take up mechanism.

11 Claims, 9 Drawing Sheets

(56) References Cited

U.S. PATENT DOCUMENTS

| | | | | |
|---|---|---|---|---|
| 3,471,943 | A | 10/1969 | Waddington et al. | |
| 3,473,843 | A | 10/1969 | Hart | |
| 3,528,653 | A | 9/1970 | Stuckenschneider et al. | |
| 3,589,720 | A | 6/1971 | Agamian | |
| 3,597,856 | A | 8/1971 | Waddington et al. | |
| 3,693,264 | A | 9/1972 | Waddington et al. | |
| 3,841,627 | A | 10/1974 | Vetter | |
| 3,912,264 | A | 10/1975 | Busse et al. | |
| 3,940,862 | A | 3/1976 | Nishimura | |
| 3,992,004 | A | 11/1976 | Feron et al. | |
| 4,396,188 | A * | 8/1983 | Dreissigacker et al. | 482/73 |
| 4,428,578 | A | 1/1984 | Kirkpatrick | |
| D277,304 | S | 1/1985 | Smith et al. | |
| 4,563,000 | A | 1/1986 | Gall | |
| D287,389 | S | 12/1986 | Nadeau | |
| 4,684,126 | A | 8/1987 | Dalebout et al. | |
| 4,714,244 | A | 12/1987 | Kolomayets et al. | |
| 4,743,010 | A | 5/1988 | Geraci | |
| 4,743,011 | A | 5/1988 | Coffey | |
| 4,750,736 | A | 6/1988 | Watterson | |
| D297,853 | S | 9/1988 | Ostrom | |
| 4,772,013 | A * | 9/1988 | Tarlow, Jr. | 482/73 |
| 4,789,153 | A * | 12/1988 | Brown | 482/111 |
| D306,750 | S | 3/1990 | Kiiski | |
| 4,943,051 | A | 7/1990 | Haskins et al. | |
| 4,974,832 | A | 12/1990 | Dalebout | |
| 5,029,849 | A | 7/1991 | Nurkowski | |
| 5,042,798 | A * | 8/1991 | Sawicky | 482/129 |
| 5,104,363 | A | 4/1992 | Shi | |
| 5,154,685 | A | 10/1992 | Chen | |
| D337,799 | S | 7/1993 | Cutter et al. | |
| 5,284,459 | A | 2/1994 | Podd, III | |
| 5,295,931 | A | 3/1994 | Dreibelbis et al. | |
| 5,328,433 | A | 7/1994 | Berman | |
| 5,342,266 | A | 8/1994 | Dailey | |
| D354,099 | S | 1/1995 | Gerschefske et al. | |
| 5,382,210 | A * | 1/1995 | Rekers | 482/72 |
| 5,387,169 | A | 2/1995 | Wang | |
| D357,041 | S | 4/1995 | McBride et al. | |
| 5,407,409 | A | 4/1995 | Tang | |
| D358,324 | S | 5/1995 | Mitchell | |
| D358,624 | S | 5/1995 | Wang et al. | |
| 5,441,469 | A | 8/1995 | Chern | |
| D362,283 | S | 9/1995 | Lee | |
| 5,478,296 | A | 12/1995 | Lee | |
| 5,505,679 | A | 4/1996 | McBride et al. | |
| 5,551,674 | A | 9/1996 | Johnsen | |
| 5,554,086 | A | 9/1996 | Habing et al. | |
| D375,767 | S | 11/1996 | Camfield et al. | |
| 5,575,740 | A | 11/1996 | Piaget et al. | |
| 5,580,340 | A | 12/1996 | Yu | |
| D378,110 | S | 2/1997 | Collinsworth | |
| 5,611,758 | A | 3/1997 | Rodgers, Jr. | |
| D390,289 | S | 2/1998 | Chen | |
| 5,722,921 | A | 3/1998 | Simonson | |
| 5,779,600 | A | 7/1998 | Pape | |
| 5,795,270 | A | 8/1998 | Woods et al. | |
| D397,745 | S | 9/1998 | Wu | |
| 5,913,756 | A | 6/1999 | Glaser | |
| D414,519 | S | 9/1999 | Wang et al. | |
| D425,585 | S | 5/2000 | Wu | |
| 6,071,215 | A | 6/2000 | Raffo et al. | |
| 6,093,135 | A | 7/2000 | Huang | |
| 6,135,930 | A | 10/2000 | Kuo | |
| 6,196,954 | B1 | 3/2001 | Chen | |
| 6,224,519 | B1 | 5/2001 | Doolittle | |
| 6,309,329 | B2 | 10/2001 | Conner | |
| 6,361,479 | B1 | 3/2002 | Hildebrandt et al. | |
| 6,371,895 | B1 | 4/2002 | Endelman et al. | |
| 6,443,877 | B1 | 9/2002 | Hoecht et al. | |
| 6,540,650 | B1 | 4/2003 | Krull | |
| 6,565,495 | B2 | 5/2003 | Slattery | |
| D477,040 | S * | 7/2003 | Conklin | D21/676 |
| 6,602,168 | B2 | 8/2003 | Duke | |
| 6,692,410 | B1 | 2/2004 | Lai | |
| 6,817,968 | B2 | 11/2004 | Galbraith et al. | |
| 6,981,932 | B1 | 1/2006 | Huang et al. | |
| 7,022,052 | B1 | 4/2006 | Lai | |
| 7,232,404 | B2 | 6/2007 | Nelson | |
| 7,252,627 | B2 | 8/2007 | Carter | |
| 7,270,630 | B1 | 9/2007 | Patterson | |
| 7,413,532 | B1 | 8/2008 | Monsrud et al. | |
| 7,455,633 | B2 | 11/2008 | Brown et al. | |
| D584,367 | S | 1/2009 | Augustine et al. | |
| 2002/0151415 | A1 | 10/2002 | Hildebrandt et al. | |
| 2003/0045406 | A1 | 3/2003 | Stone | |
| 2004/0009849 | A1 | 1/2004 | Galbraith et al. | |
| 2004/0180766 | A1 | 9/2004 | Guinn | |
| 2005/0032611 | A1 | 2/2005 | Webber et al. | |
| 2005/0130810 | A1 | 6/2005 | Sands | |
| 2005/0277521 | A1 | 12/2005 | Lat | |
| 2006/0030464 | A1 | 2/2006 | Udwin | |
| 2006/0166798 | A1 | 7/2006 | Nelson | |
| 2006/0270534 | A1 | 11/2006 | Adcock et al. | |
| 2007/0082793 | A1 | 4/2007 | Yang | |
| 2007/0149370 | A1 | 6/2007 | Brown et al. | |
| 2008/0070765 | A1 | 3/2008 | Brown et al. | |
| 2008/0070766 | A1 | 3/2008 | Brown et al. | |
| 2008/0125291 | A1 | 5/2008 | Watt et al. | |
| 2008/0261782 | A1 | 10/2008 | Campbell | |
| 2009/0018000 | A1 | 1/2009 | Brown et al. | |
| 2009/0088304 | A1 | 4/2009 | Washington | |
| 2011/0028278 | A1 * | 2/2011 | Roach | 482/72 |

OTHER PUBLICATIONS

The Final Office Action for U.S. Appl. No. 12/018,702 mailed Sep. 18, 2009 (14 pages).

The Advisory Action for U.S. Appl. No. 12/018,702 mailed Dec. 11, 2009 (3 pages).

The Office Action for U.S. Appl. No. 12/018,702 mailed Feb. 19, 2010 (16 pages).

The Final Office Action for U.S. Appl. No. 12/018,702 mailed Oct. 7, 2010 (15 pages).

The Office Action for U.S. Appl. No. 12/018,702 mailed Apr. 10, 2012 (22 pages).

* cited by examiner

ROWING MACHINE SIMULATOR

CROSS-REFERENCE TO RELATED APPLICATIONS

This application is a Continuation-in-Part of patent application Ser. No. 12/018,702, filed Jan. 23, 2008 entitled, "Rowing Machine Simulator," which claims priority to Australian Provisional Patent Application No. 2007900315 filed Jan. 23, 2007, all of which are incorporated herein by reference.

BACKGROUND

One aspect relates to rowing simulators or rowing machines. One embodiment has been developed primarily for use with dynamically balanced rowing simulators and will be described hereinafter with reference to this application. However, it will be appreciated that the invention is not limited to this particular field of use and is applicable to many different types of rowing simulators as would be understood by a person skilled in the art.

Static rowing simulators or machines have been long known for use in both general strength and fitness training, or for use specifically for oarsmen to practice their rowing. In these known static simulators, a seat is slideably mounted to a rail so as to simulate the sliding motion of a seat in a rowing boat. A typical example of a static rowing machine simulator can be found in U.S. Pat. No. 4,396,188, and reference is made to FIG. 1 which reproduces a drawing from this US prior art patent.

As shown in FIG. 1, the static rowing simulator includes an energy dissipation device in the form of a flywheel that is driven by a chain connected to a handle in front of a rower. When the rower is seated on the sliding seat, the feet are placed on footrests which are attached to the frame upon which the seat slides. A rowing or pulling motion on the handle causes the chain to move and thereby rotate the flywheel.

Unfortunately, static rowing simulators such as the example shown in FIG. 1 do not properly simulate the forces an oarsman is exposed to during normal rowing action. As such, the known static rowing simulators are acknowledged by health professionals as being potentially detrimental to the oarsman by increasing the likelihood of injury to the oarsman's knee, back and shoulders.

In order to more accurately simulate the forces that would be experienced by an oarsman in a boat, the subject of U.S. Pat. No. 5,382,210 (Rekers) was developed. A right hand side view of the Rekers simulator is shown in FIG. 2. The disclosure of the specification of the Rekers US patent is hereby incorporated herein in its entirety.

In a dynamically balanced rowing machine simulator such as Rekers, the energy dissipation device (flywheel) is also slideably mounted to the frame independent of the sliding movement of the seat. That is, during use by an oarsman, the slideably mounted seat and energy dissipation device move independently of each other apart and together as a function of the stroke of the oarsman. In the Rekers prior art, the dynamically balanced rowing machine simulator stabilizes the energy dissipation device (flywheel) and the oarsman independent of internal friction and/or hysteresis in any elastic elements in the simulators.

It will be appreciated by those skilled in the art that when an oarsman sits on the seat of the simulator of the Rekers patent, they place their feet on the foot rests which are slideably mounted with the energy dissipation device flywheel so that pulling on the rowing machine simulator handle and release thereof causes the energy dissipation device and seat to move apart and together during the initial stages of a stroke and the final stages of a stroke respectively. It is known that the disclosure of rowing machine simulators such as those of the Rekers patent provides significant improvements in the simulation of the experience an oarsman would receive when rowing a boat on the water as not only is the movement of the sliding seat simulated, but also the movement of the boat by means of the movement of the energy dissipation device (flywheel). Use of simulators such as those of Rekers reduces the risk of injury that is presented by the use of static simulators.

Whilst the rowing machine simulators of the type disclosed in the Rekers patent are significant improvements over what is known, it would be preferable to have a rowing machine simulator which yet more realistically simulates the experiences of an oarsman rowing a boat on the water. As would be understood by a person skilled in the art, other conventionally known dynamically balanced rowing machine simulators typically only address one or two specific conditions experienced during an oarsman rowing. Another disadvantage of the prior art is a propensity to become unstable during use when an oarsman is pulling on the handle.

The genesis of one embodiment is a desire to provide an improved dynamically balanced rowing machine simulator, or to provide a useful alternative.

SUMMARY OF THE INVENTION

According to an aspect of the invention there is provided a rowing machine comprising:

a longitudinally extending beam;

a seat mounted to said beam and slidable therealong;

a frame mounted to said beam and slidably movable therealong independently of said seat;

a pair foot rests mounted to a user end of said frame;

a flywheel rotatably mounted by a flywheel shaft to said frame, said flywheel shaft mounted to said frame a height less than a radius of said flywheel above said beam; and wherein said flywheel is drivable by a cable through a transmission mechanism mounted to said frame such that one end of said cable remote from said flywheel is connected to a handgrip and the other end of said cable connected to a cable take up mechanism.

It will be appreciated by those skilled in the art that use of the dynamically balanced rowing machine simulator with the flywheel configuration disposed at a height of less than a radius thereof provides a more stable simulator. This also advantageously provides a reduced operating arc regiment being about the approximate flywheel radius.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

Embodiments of the invention will now be described, by way of example only, with reference to the accompanying drawings in which.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 5:
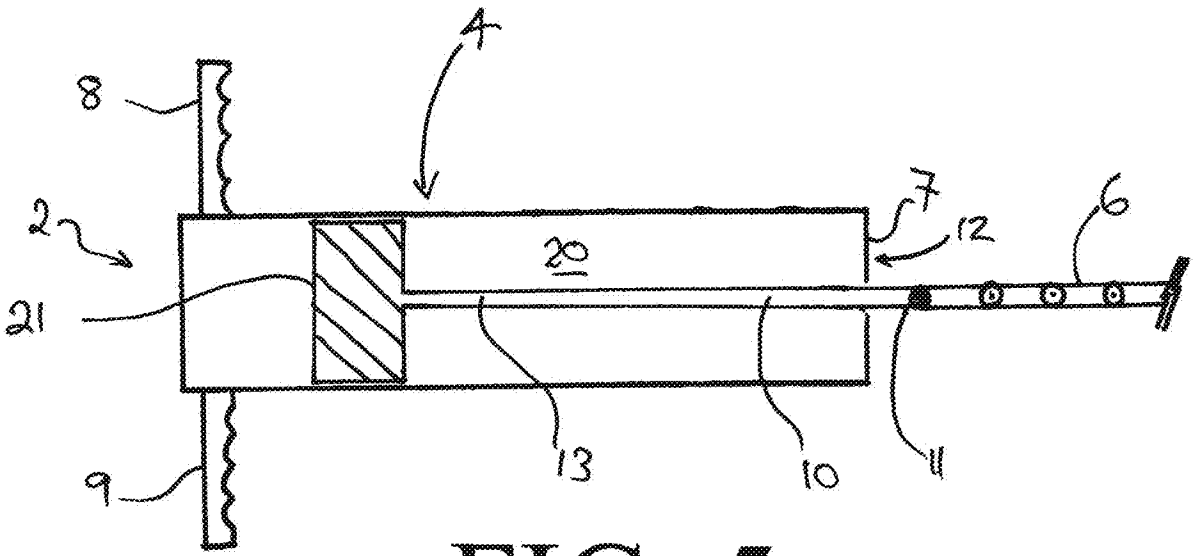
FIG. 5 is an energy storage device according to another preferred embodiment for use in a rowing machine simulator.
Figure 6:
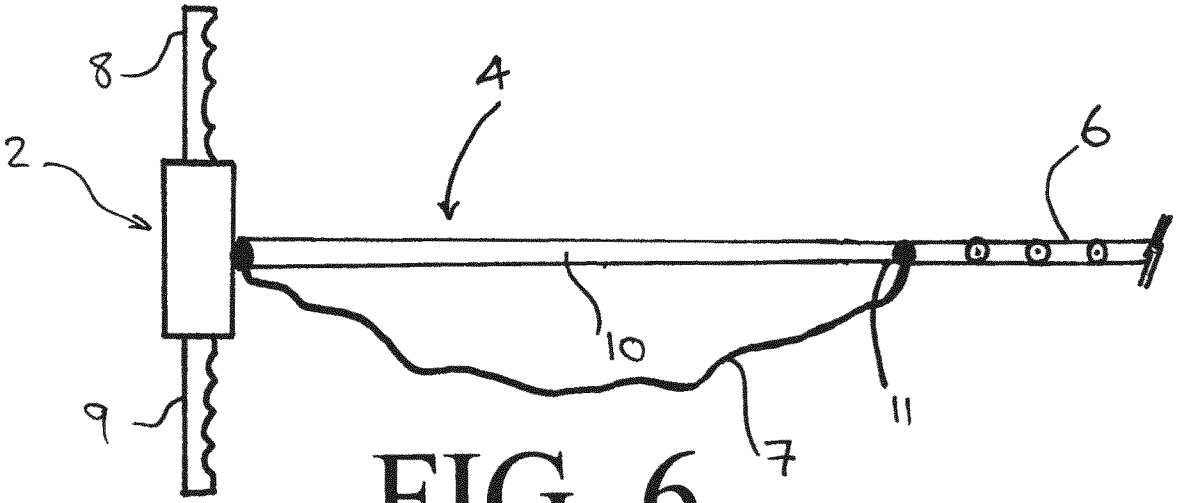
FIG. 6 is a schematic top view of an energy storage device according to a further preferred embodiment for use in a rowing machine simulator.
Figure 7:
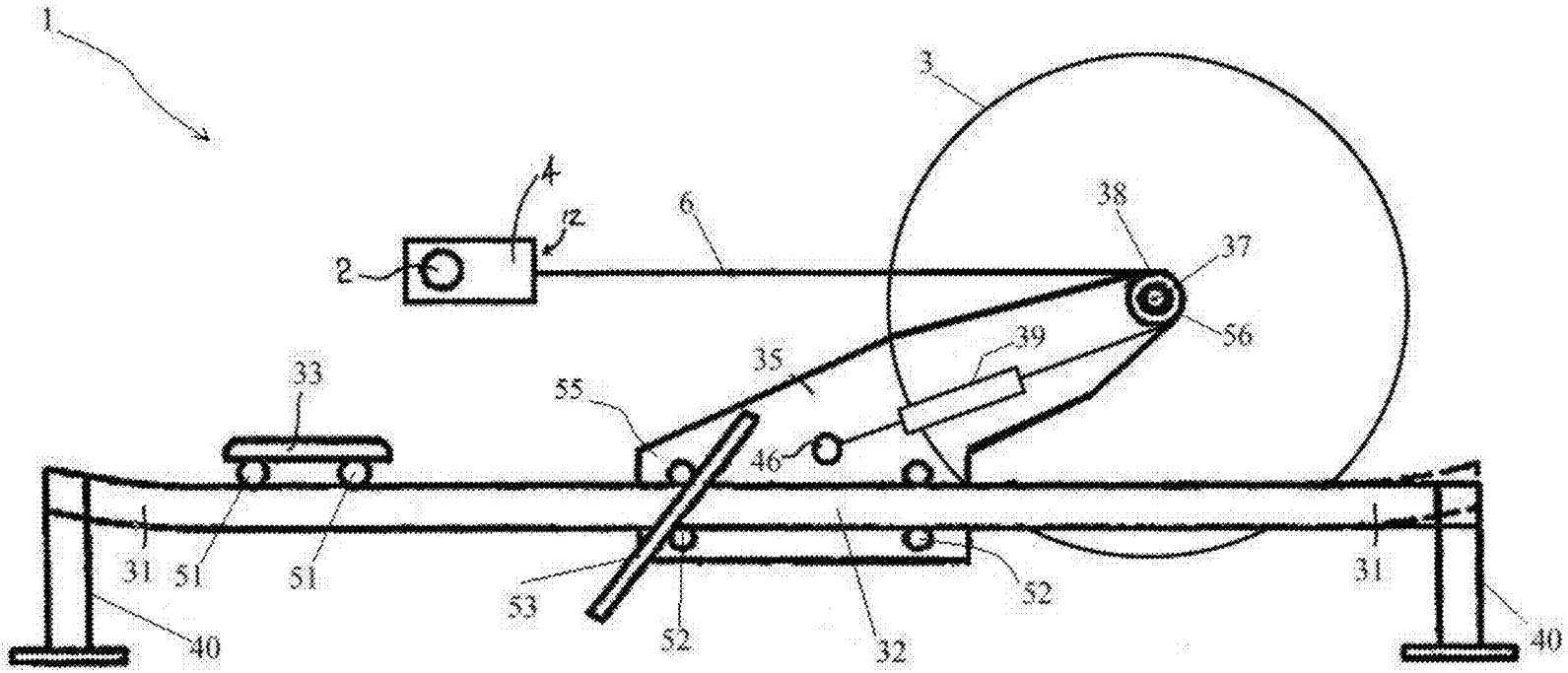
FIG. 7 is a side view of a rowing machine simulator according to a further preferred embodiment of the invention.

Referring to FIGS. 3 to 9 generally, like reference numerals have been used to denote like components. Referring firstly to FIG. 7, there is shown a rowing machine simulator 1 having a rowing handle 2 which is connected to a dynamically mounted energy dissipation device 3. It will be appreciated that the rowing machine simulator 1 can be a machine in which the energy dissipation device 3 is static and not moveable.

The rowing machine simulator 1 includes an energy storage device 4. The energy storage device 4 is configured to be disposed intermediate the rowing machine simulator handle 2 and the energy dissipation device 3. The energy storage device 4 is configured to elastically absorb a proportion of the force applied to the rowing handle 2 by an oarsman (not illustrated) during the early phase of a simulated rowing stroke. The elastically stored energy in the device 4 is released during later phases of the simulated rowing stroke when the force applied by the oarsman reduces below a pre-determined force.

The energy storage device 4 is adapted to absorb between 15% to 35% of the force applied to the rowing handle 2 by an oarsman during the early phase of a stroke. In the preferred embodiment of FIG. 3, the energy storage device 4 is configured to elastically absorb the instantaneous force applied by an oarsman during approximately the first 20% to 80% of the simulated rowing stroke. Most preferably, the storage device 4 is configured to elastically absorb the instantaneous force applied by the oarsman during approximately the first 40% of a stroke.

Figure 3:
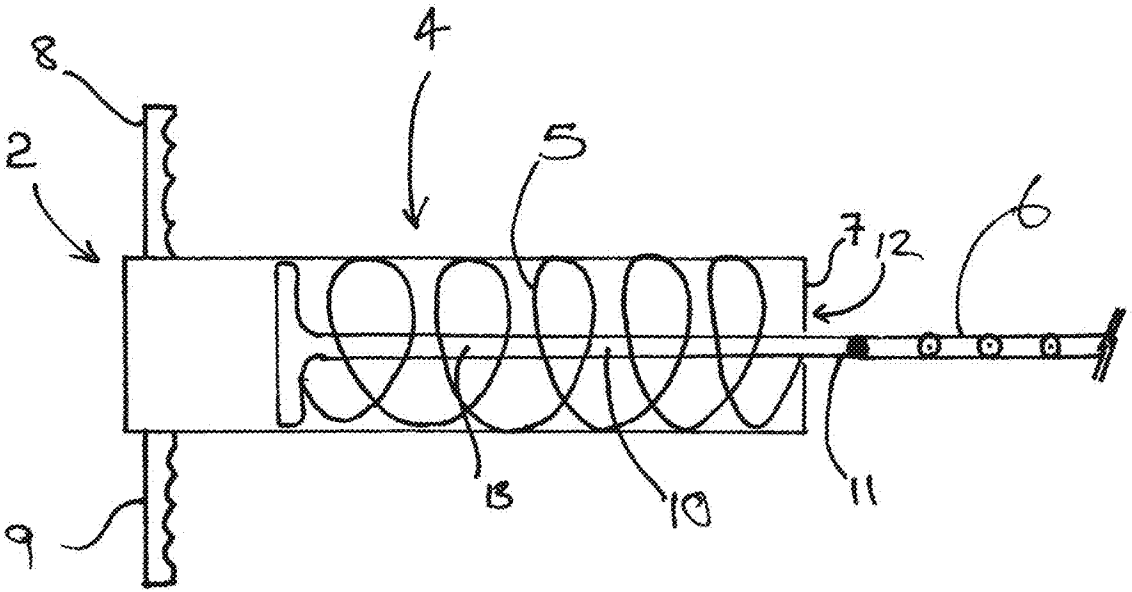
FIG. 3 is a schematic top view of an energy storage device according to a preferred embodiment for use in a rowing machine simulator.

In the preferred embodiment of FIG. 3, the energy storage device 4 is configured to elastically absorb instantaneous force applied by the oarsman during the early phase of the stroke of between 200 N to 1200 N. In other preferred embodiments, not illustrated, the energy storage device 4 is configured to elastically absorb instantaneous force applied by the oarsman of between 400 N to 800 N.

It will also be appreciated that the energy storage device 4 can include a variable energy storage capacity to absorb instantaneous forces during the early phases of a stroke applied by oarsmen having different strengths. It will also be appreciated that the energy dissipation device 3 is configured to simulate the pre-determined or preferred mass of a rowing boat with or without rowers and/or a coxswain. That is, the energy dissipation device 3 can be selected to correspond to the mass of a lightweight scull, or, if preferred a heavier boat, or indeed any preferred weight.

In the preferred embodiment of FIG. 3, the energy storage device 4 is in the form of a compression spring 5 that is configured to be connected to the rowing handle at one end and to a cable connected to the energy dissipation device 3 at the other end. It will be appreciated that the cable 6 can be indirectly connected to the energy dissipation device 3, as shown in FIG. 7, or it can be directly connected to the energy dissipation device 3 (not illustrated) as preferred.

It will also be appreciated that the cable 6 can be a chain, belt or other connection means connected to the energy dissipation device at the other end and the handle at one end. The cable could be a combination of a cable, a chain, a belt and/or other connection means as preferred and as would be appreciated by a person skilled in the art.

The energy storage device 4 includes a stop means 7 to limit the compression of the compression spring 5 during absorption of instantaneous force applied by the rower to the handle 2. The stop means 7, as shown in FIG. 3, most preferably limits the total compression of the spring 5.

As schematically shown in FIG. 7, the energy storage device 4 is disposed within a housing formed by the rowing machine simulator handle 2. The handle 2 includes a left handgrip 8 (not illustrated) spaced apart from a right handgrip 9. A shaft 10 is disposed intermediate the left and right hand handgrips 8 and 9 wherein a head 11 of the shaft 10 extends from a front 12 of the handle 2 and is releasably connected to the chain 6. The shaft 10 includes a shank end 13 configured to be substantially disposed within the handle 2.

The shank end 13 is slideably mounted within the handle between a non-energy storage position, as shown in FIG. 3, and an energy storage position (not illustrated) wherein the shank 13 is resiliently biased by compression spring 5 towards the non-energy storage position. It will be appreciated that the shank 13 can be configured to protrude a predetermined distance from the handle 2 rather than simply being substantially enclosed within the handle.

In use, the oarsman places each hand on the respective handle handgrips 8 and 9 and applies a pulling force thereto. During the early phases of the stroke, the compression spring 5 is caused to compress and store energy thereby elastically absorbing a proportion of the force applied to the handle by the oarsman. Once the oarsman ceases applying a force of a pre-determined magnitude or greater, the compression spring 5 being under compression will recoil. This happens during a later phase of the simulated rowing stroke and most preferably during the final 60% of the stroke.

In this way, it will be appreciated that the energy storage device allows the simulation of some forces experienced by an oarsman when rowing a boat on water. That is, elastic flexing experienced by an oarsman when rowing on the water with real oars in a real boat. It will be appreciated that the shaft 10 can include a hook, clip or other fixed or releasable fastening means to connect the energy storage device 4 to the chain 6.

Figure 4:
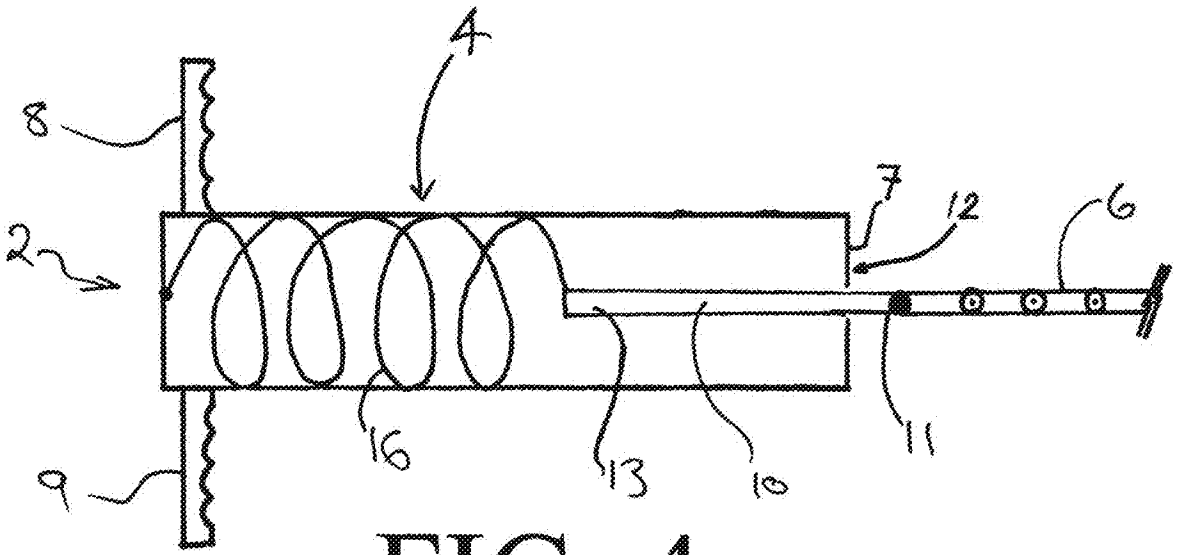
FIG. 4 is a schematic top view of an energy storage device according to another preferred embodiment for use in a rowing machine simulator.

Referring now to FIG. 4, there is shown a top view of an energy storage device according to another preferred embodiment of the invention for use in a rowing machine simulator. The rowing machine simulator can be a static or dynamically balanced simulator.

In the embodiment of FIG. 4, an expansion spring 16 is configured to be connected intermediate the handle 2 and the energy dissipation device 3 of the rowing machine simulator (not illustrated). In this preferred embodiment, the energy storage device is configured to be disposed within the rowing machine simulator handle (not illustrated) and be releasably connected to the chain 6 at the shaft head 11.

In use, one end of the expansion spring 16 is connected to the handle of the rowing machine simulator and the other end connected to the cable such that application of force by the oarsman on the handle causes the expansion spring to elastically absorb energy. As in the case with the preferred embodiment of the energy storage device 4 described with reference to FIG. 3 using a compression spring 5, a stop means 7 is employed to prevent the expansion spring being stretched beyond its elastic limit.

The energy storage device 4 using the expansion spring 16 is configured to absorb about the same amount of force applied by the oarsman to the handle during the early phase of a stroke as is described for the energy storage device 4 with reference to FIG. 3.

In FIG. 5, there is shown another preferred embodiment of the energy storage device 4 in the form of a pneumatic piston and cylinder 20 and 21 respectively. As with the other preferred embodiments, the energy storage device 4 of FIG. 5 is configured to be connected to the rowing handle at one end and to a cable (not illustrated) at the other end which is in turn connected to the energy dissipation device of the rowing machine simulator. In this way, force applied by an oarsman simulating the rowing stroke causes the cylinder and the piston to be pulled apart and to elastically absorb the energy applied during the early phases of the stroke. Once the force applied by the rower reduces below a pre-determined magnitude, the piston and cylinder are caused to return to their initial positions thereby releasing the stored energy. It will be appreciated that the energy storage device 4 of FIG. 5 performs the same function as the preferred embodiments of FIGS. 3 and 4.

Referring to FIG. 6, there is shown yet another preferred embodiment of the energy storage device 4. In this embodiment, the energy storage device 4 is not configured to be disposed within the handle 2 but is most preferably configured to connect at one end to the handle and to a cable connected to the energy dissipation device at the other end. The energy storage device 4 is in the form of an elastically deformable elastomeric material which is configured to absorb between 15% to 35% of the force applied to the rowing handle by the oarsman during the first 40% of a rowing stroke. In this embodiment, a substantially inelastic cable 7 is attached to or adjacent to each end of the elastomeric cable 4 to act as a stop 7 to prevent over-extension of the energy storage device 4.

As with the other embodiments of the energy storage device 4 described above, the elastomeric material can be configured to elastically absorb force applied by the oarsman during the first 20 to 80% of the stroke where the oarsman is applying between 200 N to 1200 N of force to the handle. In this way, the material elastically stretches and elastically absorbs the applied force releasing it when the force applied by the oarsman reduces below a pre-determined value.

It will also be appreciated that the preferred embodiments of the energy storage device 4 shown in FIGS. 4 to 6 also advantageously provide the simulation of some of the forces experienced by an oarsman when rowing a boat on the water, for example, the flexing forces of an outrigger canoe.

Referring now to FIG. 7, there is shown a rowing machine simulator 1 according to another preferred embodiment. The simulator 1 includes an energy storage device 4 as shown but this is optional and can be removed with the user end of cable 6 connected directly to handle 2.

The rowing machine simulator 1 includes a beam 31 having a pre-determined length and a substantially horizontal central portion 32. The ends of the beam 31 are supported by legs 40. The ends of the beam 31 are each preferably curved upwardly by some amount.

The simulator 1 includes a seat 33 mounted by wheels or rollers 51 to the beam 31. This allows the seat 33 to horizontally slidably move along the beam 31. The seat 33 is disposed a pre-determined height above the beam.

A frame 35 is mounted to the beam 31 by wheels or rollers 52. The frame 35 is slidably movable along the beam 31 independently of movement of the seat 33. A pair foot rests 53 (right hand foot rest 53 shown in the side view of FIG. 7) are mounted to a user end 55 of the frame 35. Each foot rest 53 extends outwardly from the frame 35 in a direction substantially perpendicular to the beam 31. The foot rests 53 extend a predetermined distance from the frame 35.

Figure 8:
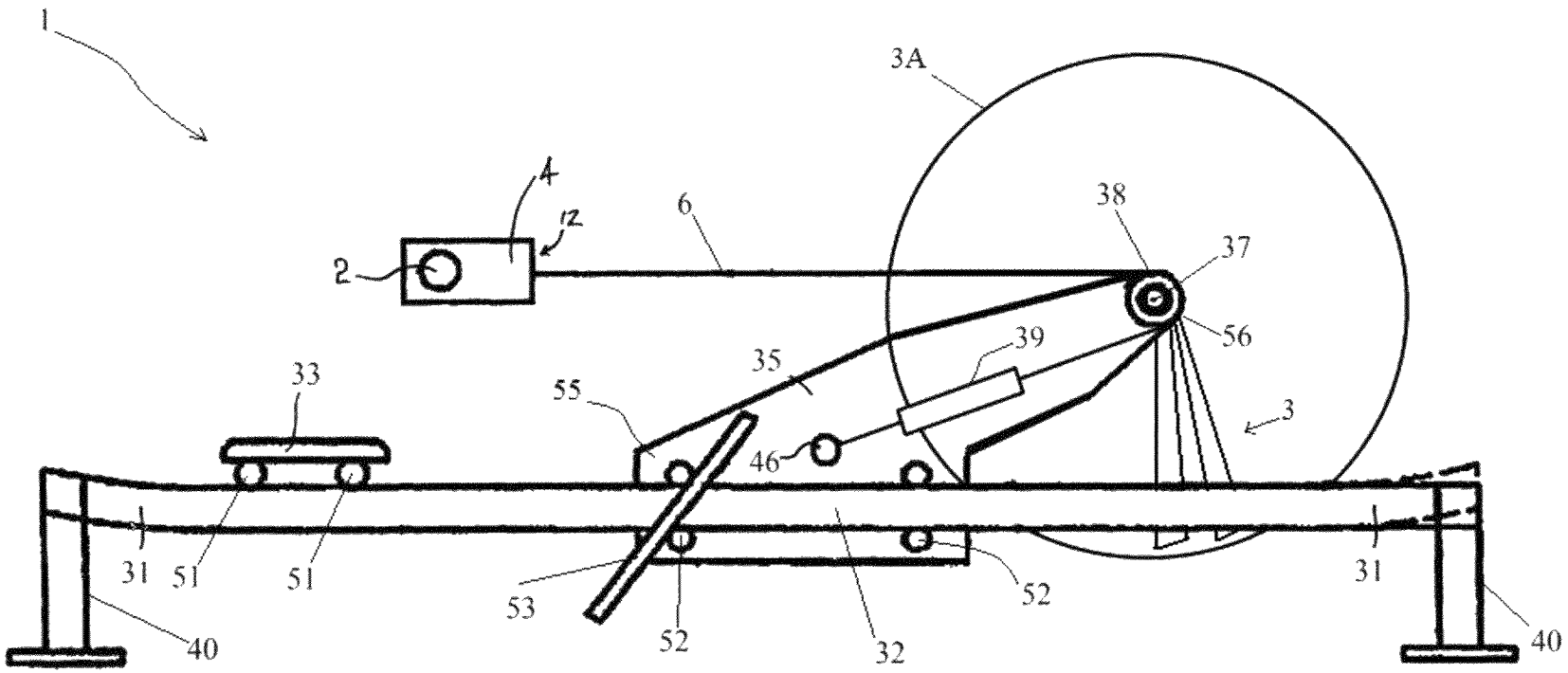
FIG. 8 is a side view of a rowing machine simulator similar to FIG. 7 with a different flywheel.

A flywheel 3 is rotatably mounted by a flywheel shaft 37 to the frame 35 at or adjacent an end 56 of the frame 35 distal the user end 55. The flywheel 3 is most preferably a solid circular disc but may be have apertures or be perforated. Further, the flywheel 3 may include a plurality of radially outwardly extending vanes that may be surrounded by an enclosure as shown in FIG. 8 where the ends of the vane define the flywheel radius which is smaller than the radius of the vaned flywheel cage denoted 3A in FIG. 8.

The flywheel 3 is mounted a height above the beam 31 of less than a radius of the flywheel 3. That is, the shaft 37 is held above the beam 31 a height of less than a radius of the flywheel. In the most preferred embodiments, the flywheel shaft 37 is disposed a height of between 5% to 90% of the flywheel radius 3 above the beam 31. However, it will be appreciated that the flywheel shaft 37 can be mounted to the frame 35 a height less than a radius of said flywheel above said beam including at the same height or where the shaft 37 is lower than the beam 31.

The flywheel 3 is driven by a cable 6 through a transmission mechanism in the form of a sprocket gear 38 mounted about the shaft 37. The sprocket 38 is able to rotate in one direction, being anti-clockwise in FIG. 7, to rotate the flywheel 3. Rotation of the sprocket 38 in the clockwise direction results in substantially free rotation of the sprocket 38 which allows for the take up of the cable 6.

One end of the cable 6 remote from the flywheel 3 is connected to a handgrip 2 for use by an oarsman seated on the seat 33. The other end of the cable 6 is connected to a cable take up mechanism 39.

The cable 6 is formed from twisted metal wires between the handle 2 and adjacent the sprocket 38 and is then formed from a chain which engages about teeth of the sprocket 38 and connects to the cable take up mechanism 39 either directly as shown in the drawings or via a cable portion connected to the chain portion and being formed from twisted metal wires. It will be appreciated that the cable 6 can be formed from any preferred material such as twisted or braided metal or fibre wires, chain, belt, cord, or any preferred combination of them.

The chain take up mechanism 39 is mounted to the frame 35 and the cable 6 is secured at anchor point 46 on the frame 35. The take up mechanism 39 includes a constant tension spring element (shown schematically in FIG. 7). In other preferred embodiments, not illustrated, the chain portion of the cable 6 adjacent the take up mechanism 39 is coupled to an elastic cord which is wound around a plurality of pulleys and then mounted to the frame 35 at anchor 46. Alternatively, the chain take up mechanism may be of the kind shown in FIG. 1 or any preferred conventional take up mechanism.

In use, an oarsman sits on seat 33, places each foot on a foot rest 53 and grasps handle 2. The oarsman pulls on the handle 2 causing the cable 6 to rotate the sprocket 38 and the flywheel 3 to rotate anti-clockwise and by doing so dissipating energy. The seat 33 and the frame 35 move away from each other when the oarsman pulls the cable 6. When the oarsman ends the pull stroke, the cable take up mechanism 39 retracts the cable 6 and the seat 33 and frame 35 move toward each other as the oarsman bends their knees. The take up mechanism 39 maintains the cable 6 under constant tension.

Figure 1:
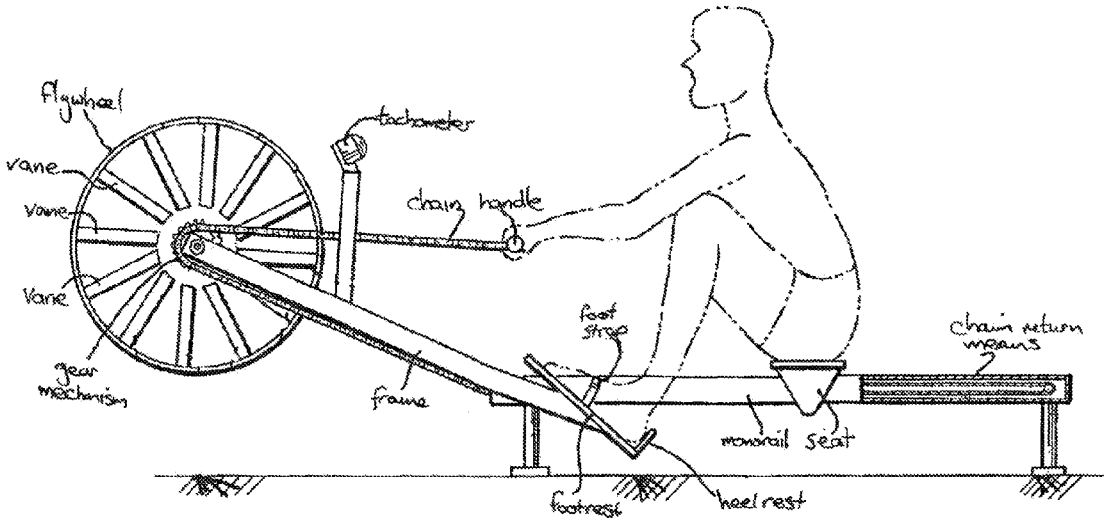
FIG. 1 PRIOR ART
FIG. 1 is a left-hand side view of a static rowing machine simulator known to the prior art.
Figure 2:
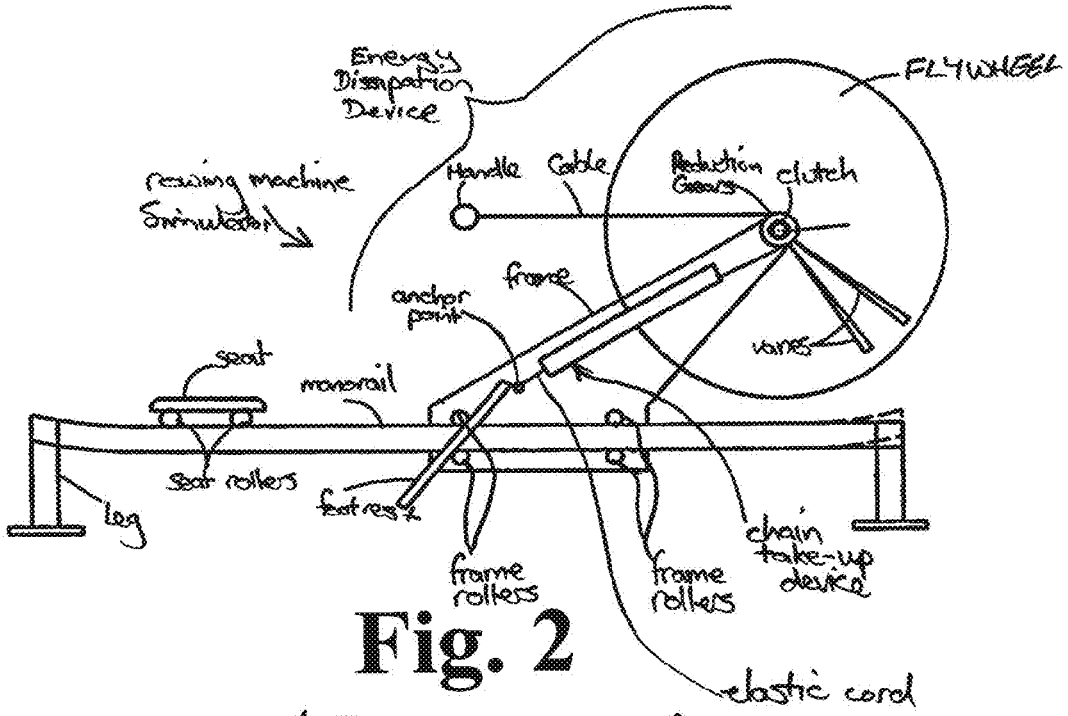
Fig. 2 (PRIOR ART)
FIG. 2 is a right-hand side view of a dynamically balanced rowing machine simulator known to the prior art.

It will therefore be seen that disposing the flywheel shaft 37 at a vertical height above the frame 35 being less than a radius of the flywheel 36 that a more stable rowing machine simulator 1 is advantageously provided. The flywheel 3 can be solid or substantially solid and with or without an enclosure or cage, or be of the kind with vanes (FIG. 8) as desired. The preferred embodiment of FIG. 1 shows a flywheel 3 with radially extending vanes (only two selected vanes shown).

Although not illustrated, it will be appreciated that the frame 35 can include an arm extending therefrom to support the flywheel shaft 37 at the predetermined height. Likewise, the transmission mechanism for converting linear motion of the cable 6 to rotation of the flywheel 3 can be any desired such as a roller mounted to the flywheel with the cable 6 wrapped around it. Further, it will also be appreciated that the beam 31 can be replaced with a pair of spaced apart parallel beams in which the seat 33 and the frame 35 each mount to both beams.

It will also be appreciated that in some preferred embodiments that an indirect drive means (not illustrated) can be disposed intermediate the handle 2/chain 6 and the drive means 38. In this way, the handle can be geared up or down to provide the required resistance. For example, the indirect drive means may be disposed at a vertical height above the beam 31 and the flywheel shaft 37 and the chain 6 may loop over the indirect drive means and then over the flywheel sprocket gear 38. This is most advantageous when the flywheel shaft 37 is some relatively close height above the beam 31, for example where the flywheel shaft 37 is say a height of 40% to 50% of the flywheel radius above the beam, and the handle 2 would be uncomfortably low relative to the height of the flywheel shaft 37.

The use of the flywheel 3 in this position results in greater stability, making the machine 1 safer in that it is less likely to topple over than conventional rowing simulator machines. With prior art rowing machine simulators, even the smallest lift could result in the machine toppling over (usually damaged in that fall). This resulted in a perception of fault lying with the machine. With the rowing machine 1 of the preferred embodiment of FIG. 7 to 9 resistance to toppling is relatively high with the result is that it takes quite a relatively large tilt before toppling. Further, a small tilt will not topple the machine 1 unlike in the prior art so that a clear indication is provided to the person lifting the machine 1 before it could topple. That is, the person lifting the machine 1 will feel the machine 1 become unstable through tipping and have time to stop and react.

It will be understood that the change in geometry practically reduces the centre of gravity and produces a more stable simulator. Furthermore, this most advantageously reduces the size of the operating arc regiment of the simulator by an amount corresponding to the reduction in relative height of the flywheel.

Figure 9:
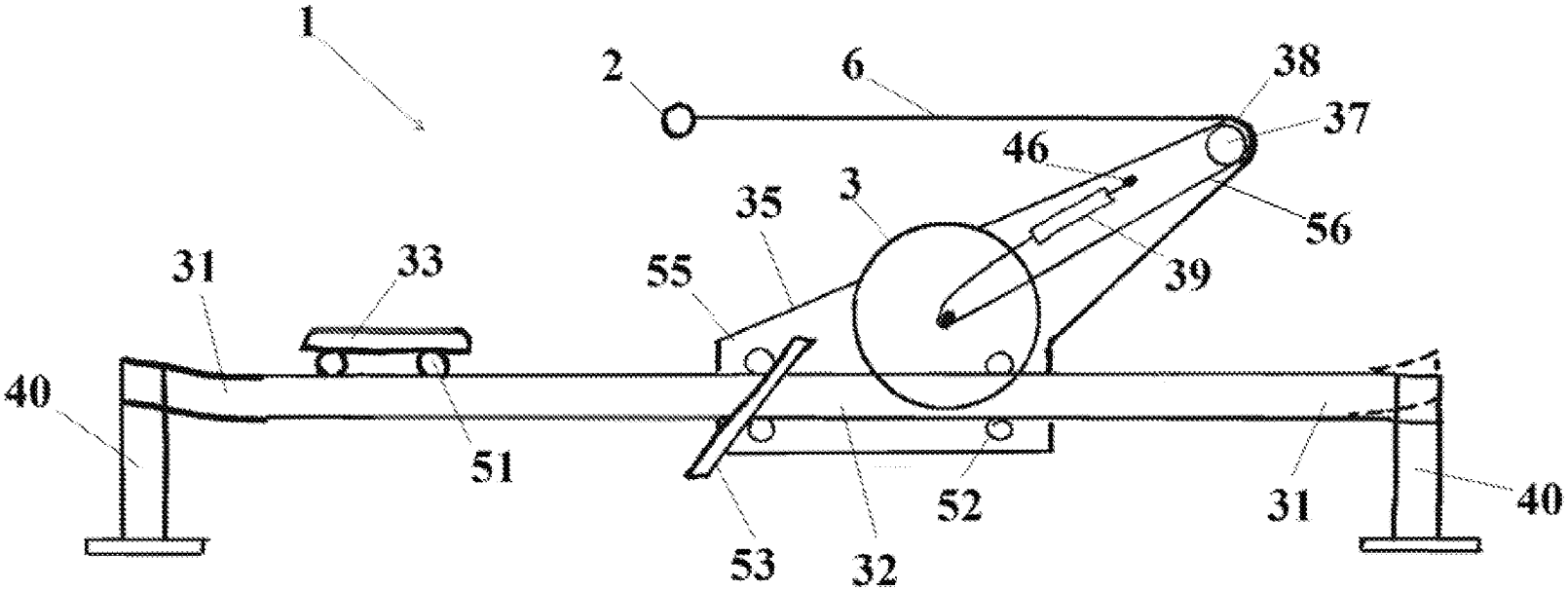
FIG. 9 is a side view of a rowing machine simulator according to another preferred embodiment of the invention.

The preferred embodiments of FIGS. 7 to 9 provide for the majority of the mass of the flywheel 3 to be concentrated near the feet of the oarsman. This advantageously makes the frame 35 feel more like a single scull kovuto 4. Further, the angular force on the rowing machine 1 is significantly reduced because the mass of the flywheel has been lowered and disposed more between the weight-bearing carriage wheels than substantially above them.

That is, the flywheel 3 is also moved closer to the wheels, bearings or rollers 52 supporting the frame 35. Instead of the typical 6-8 kg weight of the flywheel 3 plus a surrounding cage (commonly used) act as a heavy counterweight raised at the end of the frame. The forces are substantially or significantly cancelled once the user's feet are placed on the foot rests 53. It should be remembered that dynamically balanced simulators are inherently less stable than fixed seat and flywheel simulators as the seat and flywheel must move in unison.

In prior art simulators, due to angular movement of the bearings supporting the flywheel, the weight of the oarsmans feet did not practically change the angular movement of the flywheel (to which the footrest 53 is attached via frame 35) bearings. As a result, a frame having a significantly lower weight is required to keep continuous pressure on the weight bearing rollers. In the preferred embodiment, this is only about 10 kg being a significant improvement over the prior art.

Thus there is less pressure on the counter-acting bearings supporting the flywheel thereby allowing manufacture of simulators 1 with lower tolerances on the spacing of the bearings. This advantageously also eliminates the need to have adjustable axles. Previously at end of a stroke, if the gap under the rollers 52 exceeded about 0.8 mm, a bump occurred due to the flywheel weight. This has now most advantageously been eliminated due to positioning the flywheel axle above the beam by an amount less than a flywheel radius. This also makes the rolling action of the frame 35 smoother as there is less upward pressure on the lower bearing near the user's feet.

In practice, particularly in a gymnasium or institutional environment, this also reduces the effect of dust and other foreign matter building up on the beam 31 and seat rollers 51 or flywheel frame rollers 52 and affecting the operation of the rollers.

It will further be appreciated that the carrying and handling of the frame 35 is much easier when the flywheel is mounted as shown in FIGS. 7 to 9. The frame 35 can be shorter, and the mass of the flywheel is most preferably in the middle of the frame 35, where the person is carrying it, rather than at the end of the frame 35 as is typical in the prior art. Of course, reducing the length of the frame 35 reduces the size of the machine 1 which is advantageous for storage and transport.

The flywheel 3, if low enough, allows the oarsmans hands to travel over the top of it or any cage 3A if used, which they would otherwise hit, making the simulator 1 more compact depending on the size of flywheel or cage 3A. This is best shown in FIG. 9. It also offers yet another advantage in practice in that the user's hands typically require at least 4 cm clearance between take-off port for chain/drive mechanism and top of flywheel 3 or cage 3A. The embodiment of FIG. 7 provides at least this clearance allowing the user to pull from a take-off point not too artificially high.

Lastly and possibly importantly from a general consumer use perspective, the floor space required and when in use the safe operating area thereabout has been reduced by the radius of the flywheel 3 or cage 3A. This has been allowed by the reduction of height the flywheel is mounted above the beam 31. That is relatively significant, being of the order of 300 mm or so in the preferred embodiment. This is since the flywheel 3 is disposed at the end of or past the frame 35 by a significant fraction of the diameter of the flywheel. In the preferred embodiment this is about 270 mm over a flywheel diameter of 300 mm. In practical use, this makes a significant contribution.

The preferred embodiment of the invention of FIG. 9, for example, also advantageously disposes the flywheel lower (and cage 3A combination) consequently. As lowered so as not to exceed a flywheel radius above the beam(s), there is no longer an obstruction therefrom to the rower's forward field of view. Not only is this more pleasant aesthetically allowing the background to be embraced, the rower can watch the horizon, television, other background instead of the flywheel/cage combination oscillating back-and-forth dominating their vision. This last benefit has been particularly advantageous in testing as it also makes it a lot easier to synchronise with a background screen showing a crew rowing, for example. This can be a significant competitive advantage via use of the preferred embodiment of FIG. 9. The ability of the prior art machines to allow such synchronisation with fellow rowers due to mass/inertia interaction being substantially equal allowing the better field of view definitely improves that aspect.

Although not illustrated, it will be appreciated that the energy storage device can also be formed as part of the handle. For example, the left and right hand handgrips 8 and 9 may be mounted to a handle body such that application of a force by a user causes the handgrips to elastically deform. In this way, the handgrips absorb force over the first part (20% to 80%) of a stroke and release the energy once the applied force has reduced a predetermined amount later in the stroke.

Furthermore, it will be appreciated that the energy storage device can be disposed at any preferred location from the handle(s) to the energy dissipation device and still simulate the effects of a flexing oar.

The foregoing describes only preferred embodiments of the present invention and modifications, obvious to those skilled in the art, can be made thereto without departing from the scope of the present invention.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A rowing machine comprising:

a longitudinally extending beam;

a seat mounted to said beam and slidable therealong;

a frame mounted to said beam and slidably movable therealong independently of said seat;

a pair foot rests mounted to a user end of said frame;

a flywheel rotatably mounted by a flywheel shaft to said frame, said flywheel shaft mounted to said frame a height less than a radius of said flywheel above said beam; and wherein said flywheel is drivable by a cable through a drive means mounted to said frame such that one end of said cable remote from said flywheel is connected to a handle and the other end of said cable connected to a cable take up mechanism.

2. A rowing machine according to claim 1 wherein said flywheel shaft is mounted a height above said beam of between 5% to 90% of the radius of said flywheel.

3. A rowing machine according to claim 1 wherein said cable is selected from the group consisting of twisted or braided metal wires, chain, belt, cord, or a combination of two or more thereof.

4. A rowing machine according to claim 1 wherein said drive means includes a geared sprocket wheel configured to drive said flywheel upon rotation in one direction of said sprocket, said cable including a chain portion to engage with said sprocket wheel to drive said flywheel.

5. A rowing machine according to claim 1 wherein said flywheel shaft is disposed at or adjacent a front end of said frame being distal said frame user end.

6. A rowing machine according to claim 1 comprising a pair of parallel spaced apart beams wherein each of said seat and said frame are mounted to each said beam.

7. A rowing machine according to claim 1 wherein said frame comprises a body mounted to said beam and an arm extending therefrom away from said user end of said frame and terminating at a frame front end to which said flywheel is mounted.

8. A rowing machine according to claim 1 wherein said cable take up mechanism is mounted to said frame, said take-up mechanism rewinding and maintaining a predetermined tension on said cable.

9. A rowing machine according to claim 7 wherein said cable take-up mechanism comprises a constant tension spring element, or an elastic cord and a plurality of pulleys.

10. A rowing machine according to claim 1 wherein said drive means is mounted to said frame vertically higher than the top of said flywheel or than the flywheel shaft.

11. A rowing machine according to claim 10 wherein said drive means is disposed between 4 cm and 30 cm higher than the top of said flywheel.

* * * * *